United States Patent [19]

Rahman

[11] 4,008,655

[45] Feb. 22, 1977

[54] METHOD AND APPARATUS FOR PROTECTING A DOUBLE-SHELLED CHIMNEY STACK

[76] Inventor: Syed A. Rahman, 329 E. Shore Trail, Sparta, N.J. 07871

[22] Filed: Nov. 17, 1975

[21] Appl. No.: 632,213

[52] U.S. Cl. ..... 98/46; 98/58; 138/38; 138/148; 165/128

[51] Int. Cl.[2] ..... E04F 17/04

[58] Field of Search ..... 98/46, 58, 60; 110/8 A; 165/128; 138/38, 148

[56] References Cited

UNITED STATES PATENTS

| | | | |
|---|---|---|---|
| 762,203 | 6/1904 | Segerstrom | 165/128 |
| 2,011,018 | 8/1935 | Smith | 98/58 |
| 2,197,243 | 4/1940 | Moran | 138/38 |
| 2,526,097 | 10/1950 | Sveinson | 98/46 |
| 2,841,071 | 7/1958 | Strawsine | 98/46 |
| 3,513,908 | 5/1970 | Singh | 138/38 X |
| 3,693,883 | 9/1972 | Stigger | 98/58 X |

*Primary Examiner*—William E. Wayner

*Assistant Examiner*—William E. Tapolcai, Jr.

*Attorney, Agent, or Firm*—Carella, Bain, Gilfillan & Rhodes

[57] ABSTRACT

An improved chimney stack of the type having at least one flue through which gases flow and an outer shell for establishing an insulating space surrounding the flue wherein the present improvement includes heat exchanger means secured to the flue and having first and second ports with the first port extending through the outer shell and communicating with the outside air and with the second port communicating with the insulating space surrounding the flue and wherein the heat exchanger means admits and heats outside air and discharges heated outside air into the insulating space surrounding the flue during cool down of the chimney stack whereby minimization of condensation of flue gasses during cool down of the chimney stack is achieved.

15 Claims, 5 Drawing Figures

METHOD AND APPARATUS FOR PROTECTING A DOUBLE-SHELLED CHIMNEY STACK

BACKGROUND OF THE INVENTION

1. Field of the Invention

This invention relates to chimney stacks or breechings of the type having an inner shell, or flue, through which flue gases flow, and an outer shell, for establishing an insulating space surrounding the flue. Insulated chimney stacks of this type, which are well-known to the prior art, are used to prevent cooling of the hot flue gases below their dew point before being emitted from the stack, since condensation of the flue gases on the interior surfaces of the flue can cause corrosion and it can as well undesirably affect the "drafting" properties of the chimney stack.

2. Description of the Prior Art

Prior art double-shelled chimney stacks in which the insulating space is sealed are subjected to high internal pressures when the trapped air, in the insulating space, is heated during smokestack operation. The design of these prior art chimney stacks must take into account such stresses, and these designs are necessarily stronger and hence more expensive and complicated than would otherwise be necessary. Furthermore, plant startup and shutdown cause repeated cyclic stresses to the shells and plates of the chimney stack, resulting in a tendency to failure by stress corrosion or metal fatique.

Also, because of the pressure differential which may exist between the interior of the flue, through which flow the potentially corrosive flue gases, and the insulating space, there may be leakage through small cracks or pinholes which may be present in the flue. During cooldown of the chimney stack, when the pressure in the insulating space drops below atmospheric pressure, corrosive flue gases may be drawn into the insulating space and condense on the interior surface of the outer shell of the chimney stack. Since the material of the outer shell is customarily selected for mechanical strength, and not for resistance to the corrosive flue gases, it may be readily attacked and damaged by such condensation. Condensation may also take place on the outer surface of the flue as well.

A technique known to the prior art involves the use of expansion joints, such as bellows or slip joints, between sections of the chimney stack or at stack openings, to permit expansion and contraction of the insulating space with temperature changes. Descriptions of these prior art approaches to these problems may be found in U.S. Pat. Nos. 3,363,591, 3,368,506, 3,487,795, 3,537,411, 3,669,042, and 3,727,566.

Techniques using bellows are not entirely successful because materials having suitable anticorrosion properties are not, in general, well suited to the fabrication of bellows. Furthermore, to be sufficiently flexible, the bellows must be quite thin and hence relatively weak and fragile. To obviate these problems, the bellows may be coated with a corrosion-resistant lining, but this approach is not wholly satisfactory because the lining tends to crack after numerous cycles of expansion and contraction.

While certain flexible lined materials, such as synthetics, fibers, etc., are available which can withstand the corrosive flue gases, these materials are not, for the most part, completely impermeable to the flue gases under conditions of pressure differential across the bellows.

The problems associated with double-shelled chimney stacks using slip joints to permit expansion and contraction of the insulating space include gas leakage through and around the slip joint seal, as well as seal deterioration caused by the corrosive flue gases.

In both the bellows and slip joint designs, pressure differences between the insulating space and atmospheric pressure are reduced but not entirely eliminated. As a result, there remains the possibility of leakage of flue gases through minute cracks or pinholes in the flue during cooldown of the chimney stack.

SUMMARY OF THE INVENTION

The primary object of the present invention is to provide an improved double-shelled chimney stack or breeching in which the insulating space between the inner shell, or flue, and the outer shell is maintained at atmospheric pressure, thereby eliminating repeated cyclic stresses of the shells and plates resulting from plant startup and shutdown.

A heat exchanger, thermally coupled to the flue gases, or to the flue itself, serves to heat outside air before admitting it into the insulating space, thereby preventing "runaway" cooling of the insulating space by cold outside air during cooldown of the chimney stack. A further object of the invention is to minimize condensation of flue gases on the flue, or inner shell.

Still another object of the invention is to reduce permeation of the flue by the flue gases, by eliminating pressure differentials between the flue and the insulating space.

BRIEF DESCRIPTION OF THE DRAWINGS

A complete understanding of the invention can be obtained from the detailed description which follows, together with the accompanying drawings, wherein.

DESCRIPTION OF THE INVENTION

For clarity, the description that follows is in terms of a chimney stack consisting of a single flue inside an outer shell, but it is to be understood that the scope of the invention extends to breeching, i.e. ducts for conveying the gases to the chimney stack, and to arrangements involving multiple flues within a single outer shell.

Figure 1:
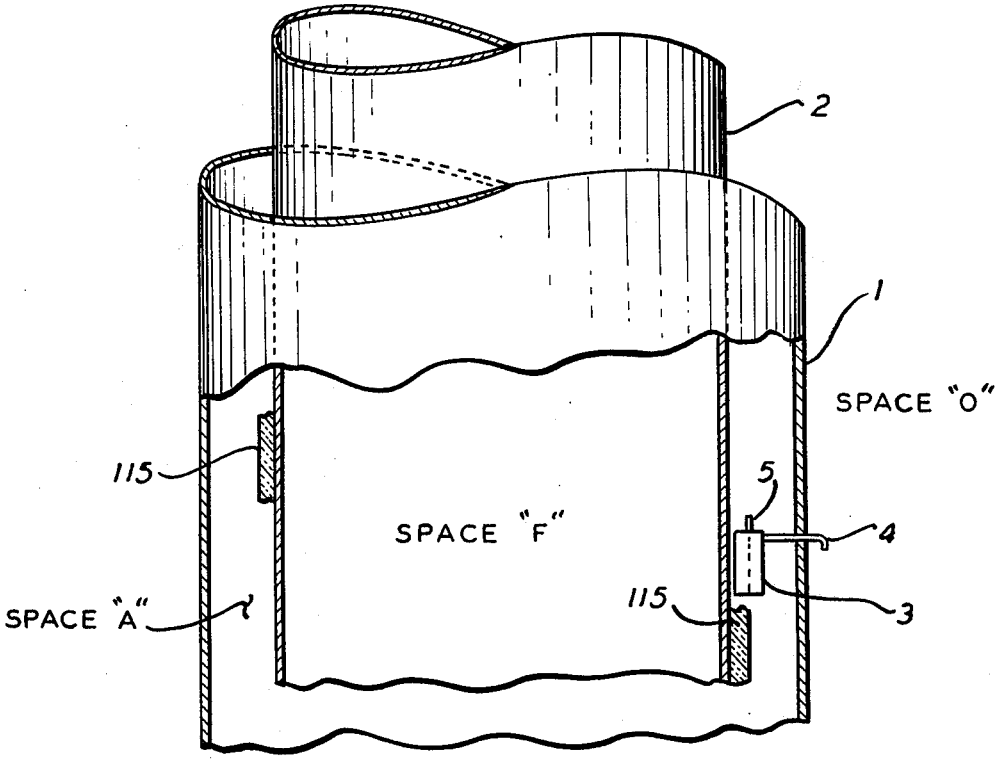
FIG. 1 is a side elevation view, with portions in cross-section, of a double-shelled chimney stack according to the present invention.
Figure 2:
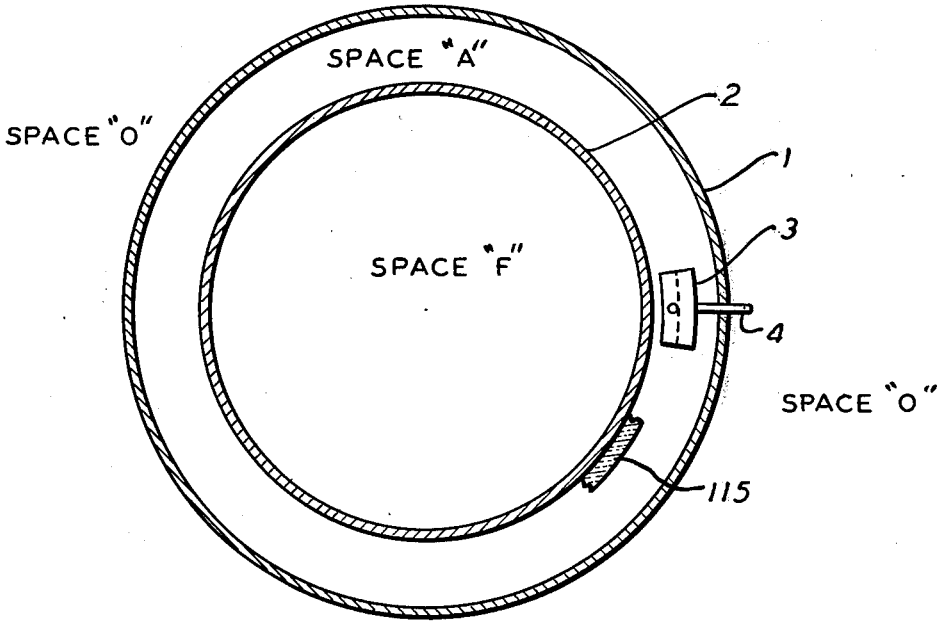
FIG. 2 is a cross-section plan view of the double-shelled chimney stack of FIG. 1.

FIGS. 1 and 2 show, in elevation and plan views respectively, the general principle of the invention. The double-shelled chimney stack or breeching, includes an outer shell 1, which surrounds a flue 2, thereby establishing an insulating space denoted in the drawings as space A. Flue 2 may also be described as an inner shell or inner flue.

The space enclosed by the flue 2 is designated space F, denoting the volume through which the flue gases flow. Space A, the insulating space between the flue 2 and the outer shell 1, may contain insulation 115, which may be arranged so as to line the exterior of the flue 2 or the interior surface of the outer shell 1. Alternatively, insulation 115 may be entirely omitted. Insulating space A, and the optional insulation 115 therein, serve to insulate flue 2 from the outside air, denoted in FIGS. 1 and 2 as space O, so as to prevent cooling of flue 2 below the dew point of the flue gases flowing through space F. Condensation of the flue gases, causing corrosion of flue 2 and possible undesirable effects on the drafting properties of the chimney stack, is thereby minimized.

The basic feature of the present invention is the heat exchanger 3, shown in FIGS. 1 and 2 secured to the outer surface of flue 2. Heat exchanger 3 includes a first port 4, which extends through the outer shell to the outside air, and a second port 5.

In operation, because the insulating space A is open to the atmosphere through the heat exchanger 3, there can be no pressure differential between the insulating space A and the outside atmosphere, space O. In this way, the air within the insulating space A is allowed to expand and contract, as the chimney stack heats and cools, without causing any pressure-related stressing of the shells and plates of the chimney stack.

A further advantage of this venting of the insulating space A to the atmosphere is the elimination of pressure differentials between the interior of the flue, space F, and the insulating space A, thereby eliminating any tendency of the flue gases to permeate the flue 2 through cracks and pinholes which are invariably present in fabricated metal parts. By eliminating this possibility of transport of the potentially corrosive flue gases into the insulating space A, the life expectancy of the chimney stack is substantially increased.

Figure 3:
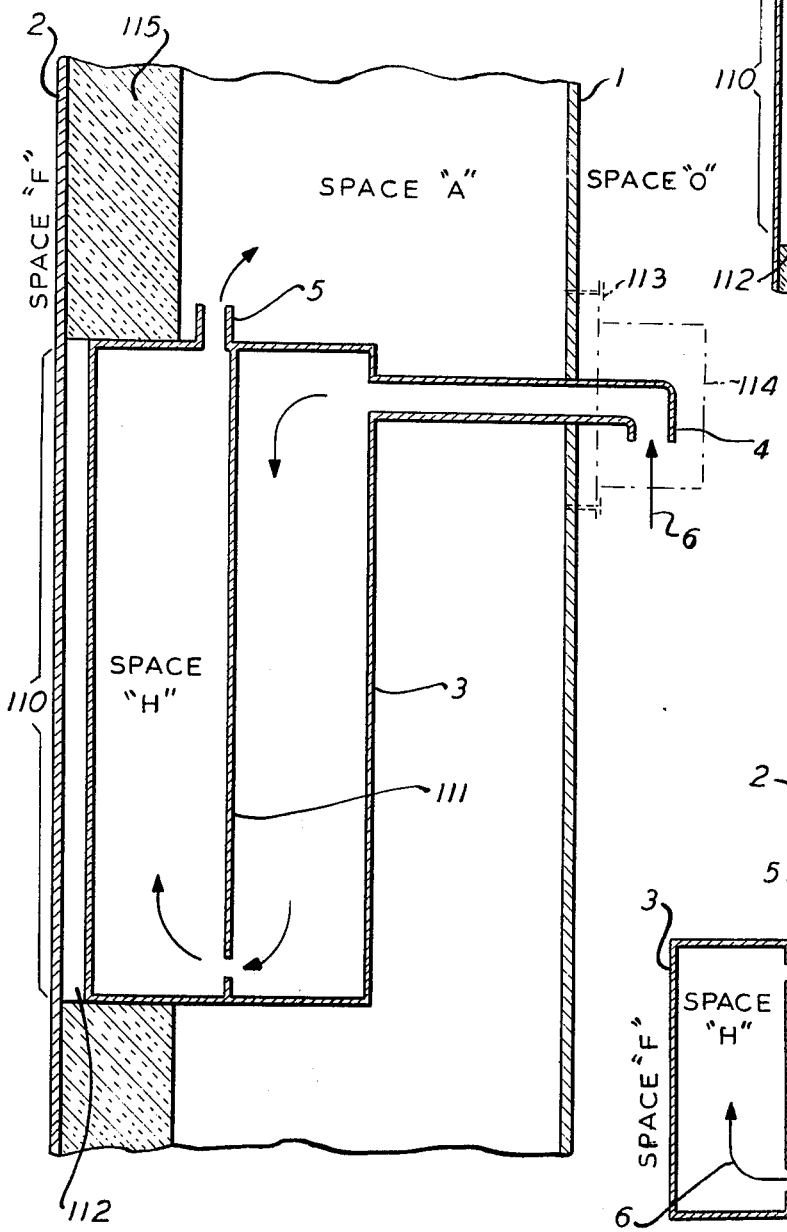
FIG. 3 is a cross-section view showing details of a heat exchanger located within the insulating space and secured to the outer surface of the flue.

FIG. 3 shows, in greater detail, the heat exchanger 3. The heat exchanger 3 includes a first port 4, extending through the outer shell 1 and venting to the outside atmosphere. During chimney stack cooldown, outside air is drawn into first port 4, through the heat exchanger 3, where it is directed around the optional divider plate 111, heated, and exhausted into the insulating space A via second port 5. Note that insulation 115, is used, is stripped away from the flue 2 where the heat exchanger 3 is mounted leaving space 112 uninsulated for best heat transfer between flue 2 and heat exchanger 3. Of course, heat exchanger 3 may also be mounted flush against flue 2. It should be noted, however, that heat transfer is best accomplished by radiation and convection and not by direct contact of the entering outside air with the flue wall. The entering outside air is warmed by heat retained in the flue itself, and not by heat retained in the insulating space A. Furthermore, the air entering the insulating space A from the heat exchanger is normally hotter than the air in insulating space A. This additional heat supply retards the cooling rate of insulating space A and thereby reduces the rate at which outside air is drawn into the insulating space A.

The heat transfer zone 110 of flue 2 may be constructed of superior corrosion-resistant material, since this area is subject to the cooling effects of the outside air during chimney stack cooldown.

Alternatively, heat exchanger 3 can be made integral with flue 2 so that the exterior surface of flue 2, in the region of the heat transfer zone 110, serves as one surface of the heat exchanger 3.

Shown also in FIG. 3 is an optional mounting flange 113, which may be incorporated for ease of installation and accessibility for repair or replacement. The optional cover 114, which may also include filters or air purifying and moisture removal devices where appropriate, serves to protect first port 4.

Figure 4:
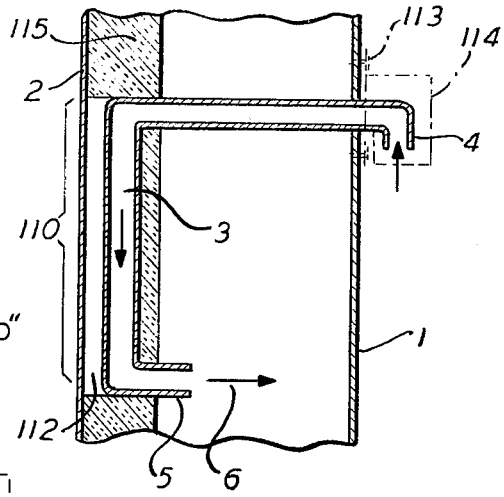
FIG. 4 shows, in cross-section, details of an alternative arrangement in which the heat exchanger is located within the insulating space and is secured to the outer surface of the flue.

FIG. 4 shows an alternative embodiment of the invention in which the heat exchanger 3 is a simple single-pass type. Inlet port 4 extends through outer shell 1 into the outside air, where it may be provided with the optional mounting flange 113 for ease of installation and accessibility for repair or replacement. Also optional is the cover 114, which may include filters or air purifying and moisture removal devices where appropriate.

Operation of the embodiment of FIG. 4 is similar to that of FIG. 3. During cooldown of the chimney stack, outside air is drawn into first port 4 and through heat exchanger 3, where it is heated by heat exchanger with flue 2 before being discharged into insulating space A. Optional insulation 115, if used, is stripped away where the heat exchanger 3 is secured to flue 2, leaving uninsulated space 112 between the heat exchanger 3 and flue 2. Depending upon temperature conditions and selection of materials, it may be advantageous to mount heat exchanger 3 flush against flue 2.

In FIG. 4, as in the embodiment of FIG. 3, a superior corrosion-resistant metal may be used for the flue 2 in the region of the heat transfer zone 110, since this region is subject to cooling by heat transfer with the outside air, with resultant condensation of flue gases.

Figure 5:
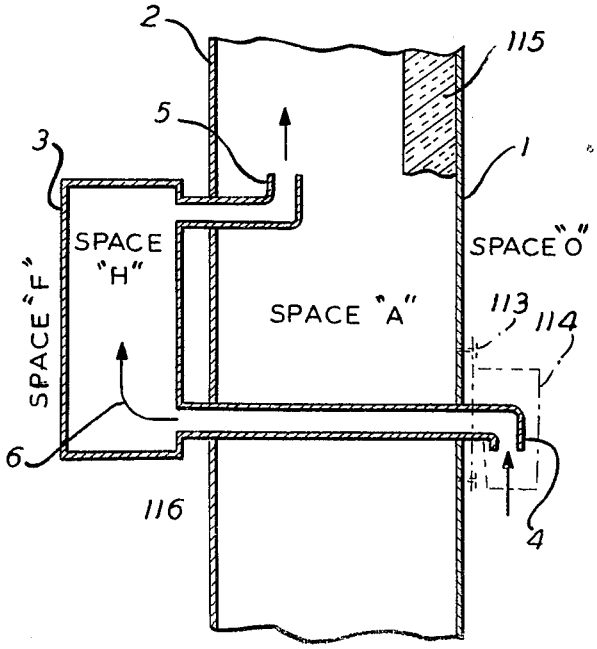
FIG. 5 shows, in cross-section, details of an embodiment of the invention in which the heat exchanger is positioned internal to the flue.

FIG. 5 shows still another embodiment of the invention in which the heat exchanger 3 is mounted within flue 2 for maximum heat transfer to the flue gases. Otherwise, operation is quite similar to that of the embodiment already described. First port 4 extends through flue 2, and on through insulating space A, and through outer shell 1 into the outside air. An optional mounting flange 113 may be provided for ease of installation and accessibility for repair or replacement of the heat exchanger 3. Also optional is cover 114, which may contain a filter or other air purifying device, or some means for removing moisture from outside air drawn into port 4.

Heat exchanger 3 also includes a second port 5, which communicates with insulating space A.

During cooldown of the chimney stack, cooling of the air within insulating space A causes outside air to be drawn into first port 4; this outside air is heated by heat exchanger 3 before being discharged, via second port 5, into insulating space A. In FIG. 5, optional insulation 115 is shown affixed to the inner surface of outer shell 1.

It should be noted that an active heater, such as an electrical or combustion heater, may be utilized in lieu of the heat exchanger 3 and, while the embodiments of the invention illustrated in FIGS. 1 through 5 show the heat exchanger 3 secured to flue 2, it will be apparent that the heat exchanger, or heater as the case may be, can as well be secured to the outer shell 1, or in fact to any other convenient structural member.

Additional devices, such as flow regulation systems or a bypass valve, may be utilized to vent the insulating space A directly to the outside air during warm-up of the chimney stack, effectively bypassing the heat exchanger 3.

It is also apparent that multiple heat exchangers or heaters, located at the same or differing heights along the chimney stack, may be utilized.

While the invention has been described by reference to a chimney stack containing only a single flue, the present invention is equally suitable to chimney stacks which include multiple internal flues within a single outer shell, and to breechings containing single or multiple flues.

It is also apparent that the first port 4 and second port 5 may be connected to heat exchanger 3 by any convenient means, including pipe or flexible tubing. Also, heat exchanger means of other types known to the art may be utilized.

While the invention has been described in terms of air flow through the heat exchanger 3 resulting from cooling and heating of insulating space A, it will be recognized that active means, such as a fan or pump, may as well be utilized.

It will be understood by those skilled in the art that many modifications and variations of the subject invention may be made without departing from the spirit and the scope thereof.

What is claimed is:

1. An improved chimney stack of the type having at least one flue, through which flue gases flow, and an outer shell, for establishing an insulating space surrounding the flue, wherein the improvement comprises:

a. heat exchanger means, secured to the flue and having a first port and a second port;

b. the first port extending through the outer shell and communicating with outside air;

c. the second port communicating with the insulating space surrounding the flue; and d. the heat exchanger means for admitting and heating outside air, and discharging heated outside air into the insulating space surrounding the flue during cooldown of the chimney stack, thereby minimizing condensation of flue gases during cooldown of the chimney stack.

2. An improved chimney stack as recited in claim 1, in which the heat exchanger means is thermally coupled to the flue.

3. An improved chimney stack as recited in claim 1, in which the heat exchanger means is located within the insulating space.

4. An improved chimney stack as recited in claim 2, in which the heat exchanger means is located within the flue.

5. An improved chimney stack as recited in claim 1, in which the heat exchanger means is thermally coupled to the flue gases.

6. An improved chimney stack as recited in claim 5, in which the heat exchanger means is located within the insulating space.

7. An improved chimney stack as recited in claim 5, in which the heat exchanger means is located within the flue.

8. An improved chimney stack of the type having at least one flue, through which flue gases flow, and an outer shell, for establishing an insulating space surrounding the flue, wherein the improvement comprises:

a. heat exchanger means, secured to the outer shell and having a first port and a second port;

b. the first port extending through the outer shell and communicating with outside air;

c. the second port communicating with the insulating space surrounding the flue; and d. the heat exchanger means for admitting and heating outside air, and discharging heated outside air into the insulating space surrounding the flue during cooldown of the chimney stack, thereby minimizing condensation of flue gases during cooldown of the chimney stack.

9. An improved chimney stack as recited in claim 8, in which the heat exchanger means is thermally coupled to the flue.

10. An improved chimney stack as recited in claim 8, in which the heat exchanger means is thermally coupled to the flue gases.

11. In a chimney stack having at least one flue, through which flue gases flow, and an outer shell, for establishing an insulating space surrounding the flue, a method for minimizing condensation of flue gases during cooldown of the chimney stack, comprising the steps of:

a. admitting outside air;

b. heating the outside air; and c. discharging the heated outside air into the insulating space surrounding the flue;

whereby, during cooldown of the chimney stack, cold outside air is heated before being discharged into the insulating space surrounding the flue, thereby minimizing condensation of the flue gases.

12. In a chimney stack having at least one flue, through which flue gases flow, and an outer shell, for establishing an insulating space surrounding the flue, a method for minimizing condensation of flue gases during cooldown of the chimney stack, as recited in claim 11, in which heating of the outside air is accomplished by heat exchange with the flue.

13. In a chimney stack having at least one flue, through which gases flow, and an outer shell, for establishing an insulating space surrounding the flue, a method for minimizing condensation of flue gases during cooldown of the chimney stack, as recited in claim 11, in which heating of the outside air is accomplished by heat exchange with the flue gases.

14. In a chimney stack having at least one flue, through which gases flow, and an outer shell, for establishing an insulating space surrounding the flue, a method for minimizing condensation of flue gases during cooldown of the chimney stack, as recited in claim 11, in which heating of the outside air is accomplished by electrical heating.

15. In a chimney stack having at least one flue, through which gases flow, and an outer shell, for establishing an insulating space surrounding the flue, a method for minimizing condensation of flue gases during cooldown of the chimney stack, as recited in claim 11, in which heating of the outside air is accomplished by combustion heating.

* * * * *